US006013225A

United States Patent [19]

Cadle et al.

[11] Patent Number: 6,013,225

[45] Date of Patent: Jan. 11, 2000

[54] SURFACE DENSIFICATION OF MACHINE COMPONENTS MADE BY POWDER METALLURGY

[75] Inventors: Terry M. Cadle, Wauwatosa; Timothy E. Geiman, Germantown; Joel H. Mandel, Hartford; Michael S. Gray, Elm Grove, all of Wis.

[73] Assignee: Zenith Sintered Products, Inc., Germantown, Wis.

[21] Appl. No.: 09/284,409

[22] PCT Filed: Oct. 15, 1997

[86] PCT No.: PCT/US97/18771

§ 371 Date: Apr. 12, 1999

§ 102(e) Date: Apr. 12, 1999

[87] PCT Pub. No.: WO98/16338

PCT Pub. Date: Apr. 23, 1998

Related U.S. Application Data

[60] Provisional application No. 60/028,415, Oct. 15, 1996.

[51] Int. Cl.[7] ..... B22F 3/16; B22F 3/24

[52] U.S. Cl. ..... 419/29; 419/38; 419/54

[58] Field of Search ..... 419/29, 38, 54

[56] References Cited

U.S. PATENT DOCUMENTS

| | | | |
|---|---|---|---|
| 1,894,836 | 1/1933 | Sykes | 419/29 |
| 2,187,589 | 1/1940 | Lenel | 75/22 |
| 2,333,573 | 11/1943 | Kalischer | 75/22 |
| 2,882,190 | 4/1959 | Thomson et al. | 148/12 |
| 3,303,066 | 2/1967 | McGee | 148/126 |
| 3,416,976 | 12/1968 | Brill-Edwards | 148/12.4 |
| 3,626,570 | 12/1971 | Kushnir et al. | 29/182 |
| 3,658,604 | 4/1972 | Hale | 148/126 |
| 3,725,142 | 4/1973 | Huseby | 148/16 |
| 3,897,618 | 8/1975 | Church | 29/420.5 |
| 4,011,108 | 3/1977 | Hellman et al. | 148/11.5 P |
| 4,486,240 | 12/1984 | Sciaky | 148/4 |
| 4,508,681 | 4/1985 | Bodden et al. | 419/29 |
| 4,533,400 | 8/1985 | Benedict | 148/4 |
| 4,539,461 | 9/1985 | Bendict et al. | 219/121 L |
| 5,447,580 | 9/1995 | Semiatin et al. | 148/565 |
| 5,562,786 | 10/1996 | Hayashi et al. | 148/579 |

OTHER PUBLICATIONS

PCT International Search Report in PCT/US97/18771, dated Mar. 31, 1998.

Patent Abstracts of Japan, Publ. No. 61250103, Publ. Date Jul. 11, 1986, vol. 011, No. 102 (M–576), Mar. 31, 1997.

Patent Abstracts of Japan, Publ. No. 58164704, Publ. Date Sep. 29, 1983, vol. 007, No. 291 (M–265), Dec. 27, 1983 and translation of Publ. No. 58164704.

Patent Abstracts of Japan, Publ. No. 61 264105, Publ. Date Nov. 22, 1986, vol. 011, No. 123 (M–581), Apr. 17, 1987.

ASM Handbook, vol. 7, Powder Metallurgy, pp. 374–375, Jun. 1984.

*Primary Examiner*—Daniel J. Jenkins

*Attorney, Agent, or Firm*—Quarles & Brady LLP

[57] ABSTRACT

A sintered powder metal part is surface densified by surface heating followed by repressing. Surface heating is preferably done to a temperature which is just below the critical temperature where the steel alloy material of the part transforms from a ferritic to an austenitic microstructure. Repressing is in a die set which is smaller than the part by 10% of the surface heated depth. The hot skin is compressed and densified between the die and the cooler, and therefore less malleable core of the part Following surface densification, the part may be resintered and/or heat treated.

14 Claims, No Drawings

SURFACE DENSIFICATION OF MACHINE COMPONENTS MADE BY POWDER METALLURGY

CROSS-REFERENCE TO RELATED APPLICATION

This claims the benefit of U.S. Provisional Patent Applications No. 60/028,415 filed Oct. 15, 1996.

BACKGROUND OF THE INVENTION

1. Field of the Invention

This invention relates to powder metallurgy, and in particular to a method of making a surface densified and hardened powder metal part.

2. Discussion of the Prior Art

Many components of machines are required to function in rolling and rubbing contact at high surface pressures. This action causes wear by a variety of well known mechanisms including: abrasion, scuffing (galling) and surface pitting (rolling contact fatigue). An economical and well-known method of manufacture of machine components is by powder metallurgy (P/M) which involves compaction of a blend of fine powders of appropriate composition in a set of tools that result in a precise shaped preform. The preform is then subjected to heat in a process called"sintering" which bonds the powder particles together and alloys the blend ingredients to form the desired microstructure. The sintered product can then be heat treated conventionally to harden the surface or whole part to increase wear resistance.

It has been found by experiment that wear resistance against heavy rolling contact requires a surface layer or skin of high integrity to withstand the subsurface micro scale cracks. These cracks eventually propagate and join together until a small fragment of surface material breaks away leaving a small pit. This process spreads to form larger areas of pitting. Eventually the machine operating noise becomes a problem or in extreme cases, the surface fails leading to mechanical breakdown of the machine. In order to raise the surface integrity of a P/M mechanical component such as a roller or gear or sprocket, the surface density must be increased to an appropriate level. This can be accomplished in several ways including raising the density by repressing the whole sintered product in the cold or heated condition. Alternatively the surface can be densified locally by a rolling action. In the case of a gear or sprocket, the latter involves rolling and meshing against a master gear or sprocket at higher pressure. This process requires an expensive precision master former which has limited life due to wear, and depth of densification is limited.

SUMMARY OF THE INVENTION

The invention provides a method of making a surface densified powder metal part in which, after initial compressing and sintering, the cooled part is surface heated to a surface heated depth so as to produce a hot skin which is at a temperature above the core temperature of the part. The part is then repressed in a second die set. This compresses the hot skin between the die and the cooler, less malleable core of the part, to densify the surface of the part.

Following surface densification in this manner, the part may be resintered and/or heat treated or hardened.

Preferably, the surface heating is done to a temperature which is just below the critical temperature, which is the temperature at which the steel material of the part transforms from a ferritic to an austenitic microstructure.

In addition, the second die set, in which the part is repressed, is advantageously smaller in at least one dimension than the surface heated part by approximately 10% of the surface heated depth, to provide a desirable degree of surface densification.

These and other objects and advantages of the invention will be apparent from the detailed description.

DETAILED DESCRIPTION OF THE PREFERRED EMBODIMENTS

The present invention teaches an alternative less costly and potentially deeper skin approach to surface densification which involves localized surface heating of the P/M component being treated, followed by compression of the hot surface by pressing the component into a shaped die which is slightly smaller (e.g., in diameter) than the product. This causes compressive forces in the hot surface. The unheated core acts as a restraint against which the hot surface is compressed. This is in contrast to conventional hot repressing in which the whole body is pre-heated and the hot core also compresses, thereby preventing effective surface densification.

In the present invention, the controlled surface heating can be achieved by induction heating using a conventional high frequency industrial unit. Careful selection of power, time of current passage and cyclic frequency enables a controlled depth of material (skin) to be heated to the desired temperature.

One aspect of the invention involves heating the surface of the P/M steel component to a temperature which is just below the critical temperature (where a steel transforms from a ferritic to an austenitic microstructure). This takes advantage of the lower flow stress associated with the ferritic form. This also limits the temperature to a level that is not too injurious to the repressing tooling. A typical temperature is in the region of 600 to 800 degrees Celsius and is selected based upon the steel composition, product geometry and operations stress levels to be borne.

An example of a product which can advantageously be made in accordance with the present invention is a transmission sprocket for an automobile. The outer teeth are used to transmit engine power to the drive system via a linked chain The chain links rub and roll against the sprocket teeth resulting in highly localized stresses which lead to surface pitting as described above. The P/M process involves compaction of a steel powder blend consisting of a prealloyed base iron containing two percent nickel, plus one percent of graphite and half a percent of a pressing lubricant which is an organic stearate. The powder is blended for 30 minutes to homogenize the composition. It is then left to stand and settle for one hour before being charged into a hopper that feeds the powder into a compaction press die set and tooling. The compaction press then compresses the powder, forming a compact which is ejected from the tooling. The compact is then subjected to the thermal process called sintering (described above) which results in a structural component, after cooling to room temperature, with a density of 90% of fully dense steel. The component is then subjected to surface heating by induced currents which raise a surface layer of about 2 millimeters depth to a temperature of 700 to 750 degrees Celsius. The part is immediately pushed into a second die set which is preheated to about 400 degrees Celsius and is smaller in radius than the surface heated product by approximately 10% of the surface heated depth, which in this case is 0.2 millimeters. Therefore, the die diameter is approximately 0.4 millimeters smaller than the surface heated product. This die diameter may require fine tuning for optimal results in specific cases.

Following the surface densification, the surface layer is above 95% of theoretical density to a depth of at least 0.5 mm and preferably to 1 mm depth, which is below the depth of Hertzian stresses in the example chosen.

To raise the hardness of the densified surface layer, a post-treatment of conventional induction heating and quenching is used followed by tempering to enhance teeth toughness at 180 degrees Celsius for one hour.

In another example of the invention the product is a helical gear, also used to transmit power in a machine. In this case the powder blend is based upon a prealloyed 2% nickel, 0.5% molybdenum steel powder with elemental additional of 1% each of nickel and of copper powder. The blend is completed by 0.9% graphite powder and 0.3% of organic stearate. The compaction process involves rotating tooling to comply with the helical gear tooth form. The die walls are lubricated with a sprayed coating of a solution of water and organic stearate. The die is preheated to about 400 degrees Celsius so that thermal shock is minimized and the lubricant spray flash dries on contact with the surface. The compacted preform is then sintered at a low temperature (1600 degrees Celsius) to avoid any hardening from martensite formation. The helical gear is induction surface heated to produce a 2 millimeter hot skin at 700–750 degrees Celsius and is repressed in an undersize die as described in the first example. The resultant product is then re-sintered in a specially modified furnace which heats the part to 1130 degrees Celsius for 15–30 minutes and then fast cools to room temperature to produce the hardened microstructure of martensite. The gear is then tempered for one hour at 180 degrees Celsius to complete the process. The resultant gear has a densified hard skin which is between 0.5 and 1 millimeter deep to at least 95% of theoretical density.

In sum, the invention provides a process and resulting ferrous powder metallurgy product which has a densified skin produced by heating a surface layer to soften it in readiness for a repressing operation in an undersized die which compresses the hot, soft skin against the relatively cold, hard core, leading to localized skin densification. This is especially useful where the component is a power transmitting part such as a gear or sprocket or roller. A preferred method of heating the skin prior to repressing is by induction heating. It is also useful to make the base material an air hardening steel which hardens during subsequent processing in a fast-cool furnace.

Many modifications and variations to the preferred embodiments described will be apparent to those skilled in the art. Therefore, the invention should not be limited to the preferred embodiments described, but should be define by the claims which follow.

We claim:

1. A method of making a surface densified powder metal part, comprising the steps of:

compressing a powder metal material in a first die set so as to form a compact in the general size and shape of the part;

sintering said compact to make said part;

surface heating said part to a surface heated depth so as to produce a hot skin which is at a temperature which is below a critical temperature of said material but above a temperature of a core of said part, said core being below said hot skin, said critical temperature being the temperature at which said material transforms from a ferritic to an austenitic microstructure; and repressing said surface heated part in a second die set.

2. The method of claim 1, further comprising the step of heat treating said part after said repressing step.

3. The method of claim 2, wherein said heat treating comprises heating, quenching and tempering said part.

4. The method of claim 1, wherein said surface heating is accomplished by induction heating.

5. The method of claim 4, wherein said repressing step immediately follows said surface heating step.

6. The method of claim 5, wherein said surface heating is done to a depth of approximately 2 millimeters.

7. The method of claim 5, wherein said second die set is smaller than said surface heated part by approximately 10% of said surface heated depth.

8. The method of claim 1, wherein said surface heating is done to a temperature of approximately 600 to 800 degrees Celsius.

9. The method of claim 1, wherein said powder metal material is a steel powder blend.

10. The method of claim 1, further comprising the step of resintering said part after said repressing step.

11. The method of claim 10, wherein said resintering step includes heating said part followed by fast air cooling said part.

12. The method of claim 11, wherein said powder metal material is an air hardening steel.

13. The method of claim 11, further comprising the step of tempering said part after said resintering step.

14. A product made by the method of claim 1.

* * * * *